United States Patent [19]

Roccaforte et al.

[11] 4,250,993

[45] Feb. 17, 1981

[54] CARTON FOR CONTAINER AND CAP

[75] Inventors: Harry I. Roccaforte, Western Springs, Ill.; Richard J. Dewiggins, Fairfield, Ohio

[73] Assignee: Champion International Corporation, Stamford, Conn.

[21] Appl. No.: 51,890

[22] Filed: Jun. 25, 1979

[51] Int. Cl.[3] ..... B65D 77/00

[52] U.S. Cl. ..... 206/216; 229/15; 229/27

[58] Field of Search ..... 206/216; 229/15, 27 R

[56] References Cited

U.S. PATENT DOCUMENTS

| | | | |
|---|---|---|---|
| 1,898,231 | 2/1933 | Weiss | 229/27 |
| 2,060,513 | 11/1936 | Marx | 229/27 |
| 2,150,743 | 3/1939 | Mancuso | 229/27 |
| 2,682,949 | 7/1954 | Whitehead | 229/27 |
| 3,510,046 | 5/1970 | Reiner | 229/27 |
| 3,869,062 | 3/1975 | Jagschke et al. | 229/27 |
| 4,143,803 | 3/1979 | Taylor | 229/27 |

FOREIGN PATENT DOCUMENTS

| | | | |
|---|---|---|---|
| 83511 | 7/1964 | France | 229/27 |

*Primary Examiner*—Joseph M. Moy
*Attorney, Agent, or Firm*—Evelyn M. Sommer

[57] ABSTRACT

A compartmented container made from a single integral blank wherein, on a succession of folds a vertical auxiliary compartment is formed and a vertical main compartment is formed with the carton having a bottom closure permitting the loading therein of a container and one of the walls of the auxiliary compartment having an upwardly extending flap adapted to receive and retain an additional cap for said container and maintain it near the top of said auxiliary carbon thereby making it possible to pierce or otherwise open the container in the main carton and thereafter to find ready access to the additional cap for reclosing. The upwardly extending flap is a resilient tab or panel which retains and raises the additional cap toward the top of said carton. An auxiliary wall which provides the partition between the main compartment and the auxiliary compartment is an extension of a transversely short vertical panel which in turn extends from one of the side panels along one main wall and itself has an extension adhesively secured to the opposite back wall in order to establish the auxiliary compartment and make it possible to construct the unit from a single blank.

5 Claims, 6 Drawing Figures

CARTON FOR CONTAINER AND CAP

The present invention relates to cartons and more particularly to a compartmented carton adapted to contain a dispensing or other can of material in one of the compartments and adapted, in the other compartment to contain the cap for said container in a manner to display both the can and the cap while supporting the cap near the top of the carton for accessibility.

In selling and dispensing various types of materials, it is sometimes necessary to devise specially shaped cans or containers having caps or dispensing spouts which are unique to a particular use of the material. It is therefore desirable, from a consumer marketing standpoint, to package the container and the cap in a manner which quickly draws the consumers' attention to the unique cap.

For example, materials suitable for use in unclogging stopped-up drains are dispensed from a can-like container having a dispensing spout which is specially configured to matingly engage one type of drain often used in plumbing systems. An adaptor cap which can be installed by the consumer over the dispensing spout, adapts the container for use with another common type of sink drain. The adaptor cap is packaged in a carton along with the container to allow the consumer to utilize the container with or without the adaptor cap, depending on his or her type of drain.

In the past, adaptor or auxiliary caps having been removably attached to the container if the container is not packaged within a carton, or to the exterior of the carton if the container is so packaged in a carton. This merchandising method is undesireable, however, since when the product is placed on supermarket shelves the adaptor cap and container may become easily separated.

A principal object of the present invention is to provide a compartmented paper carton container having a major compartment and an auxiliary compartment. The major compartment may be utilized for the container of the material, while the auxiliary compartment may be utilized for storing the adaptor cap for the container.

One of the problems when such an auxiliary compartment is used without any special effort to make the compartment of different depth than the main compartment is that the cap placed in the auxiliary compartment would fall to the bottom of the auxiliary compartment and it might then be difficult to retrieve it causing the exertion of some effort which is not expected of the consumer or customer. Hence, another object of the present invention is the provision in the carton for such a container and cover of means for supporting the adaptor cap near the upper opening of the carton so that adaptor cap may readily be accessible.

In addition, since the auxiliary compartment provides means for storing the adaptor cap, the cap itself may be utilized to indicate the fact that the product may be used in various applications, such as for use with different types of drains. An appropriate opening may then be provided in the side of the auxiliary compartment registering with the cap when it is in position in the auxiliary compartment in order to make the side of the cap visible.

The foregoing and many other objects of the present invention will become apparent from the following description and drawings in which.

Figure 1:
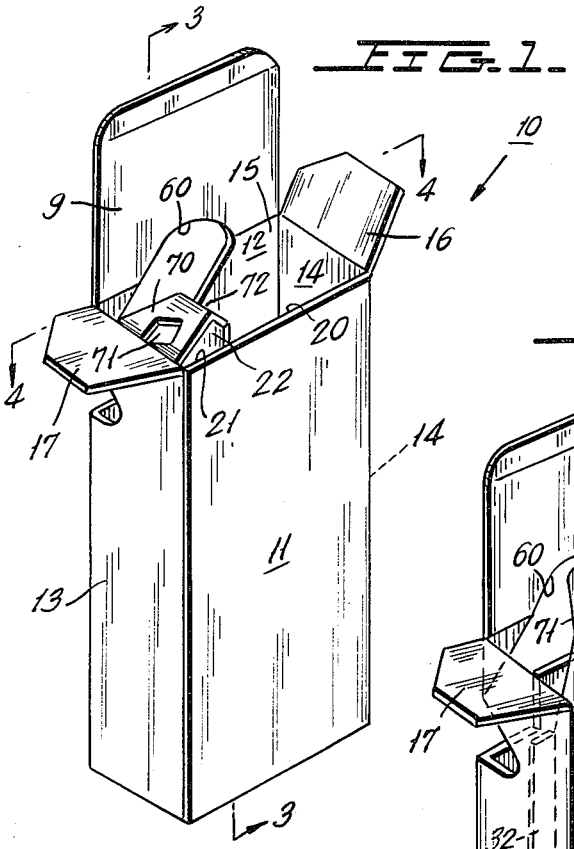
FIG. 1 is a view in perspective of the compartmented carton of the present invention fully erected and ready to receive both the container and the adaptor cap.

The compartmented carton 10 of the Figures comprises a front wall 11, a rear wall 12, side walls 13, 14 a top sealing flap 14*a* at the upper opening 15 between the walls 11 and 12 and dust excluding flaps 16 and 17 at the top of the side walls 13 and 14 at the opening 15.

As will be seen particularly from FIGS. 1, 2, 4 and 5, the carton 10 has a main compartment 20 and an auxiliary compartment 21. The main compartment 20 is defined by the side wall 14, the auxiliary panel 22 and the parts of the front and back walls 11 and 12 between the auxiliary panel 22 and the side wall 14. The auxiliary compartment for the cap of the included or packaged container hereinafter described is defined by the opposite side of the said auxiliary panel 22, the side wall 13 and the portions of the walls 11 and 12 between the members 22 and 13.

Figure 2:
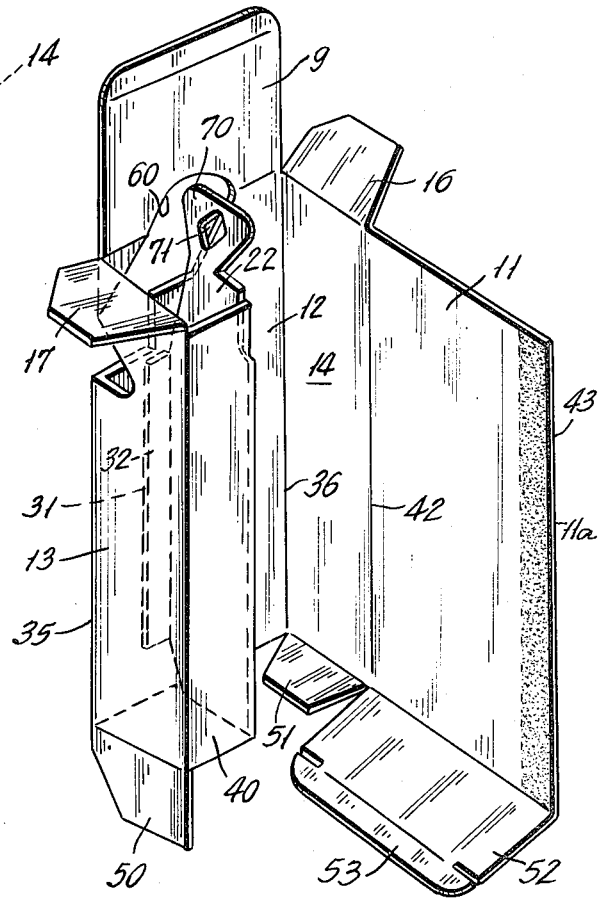
FIG. 2 is a view in perspective of the carton partially erected.
Figure 3:
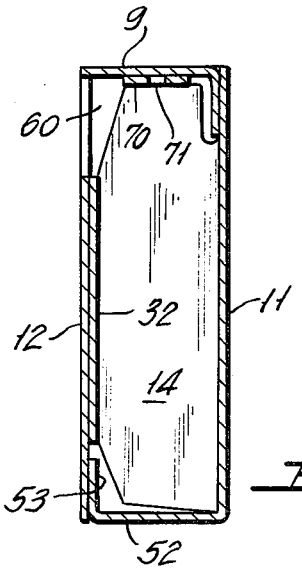
FIG. 3 is a cross-sectional view taken from line 3—3 of FIG. 1 looking in the direction of the arrows.
Figure 6:
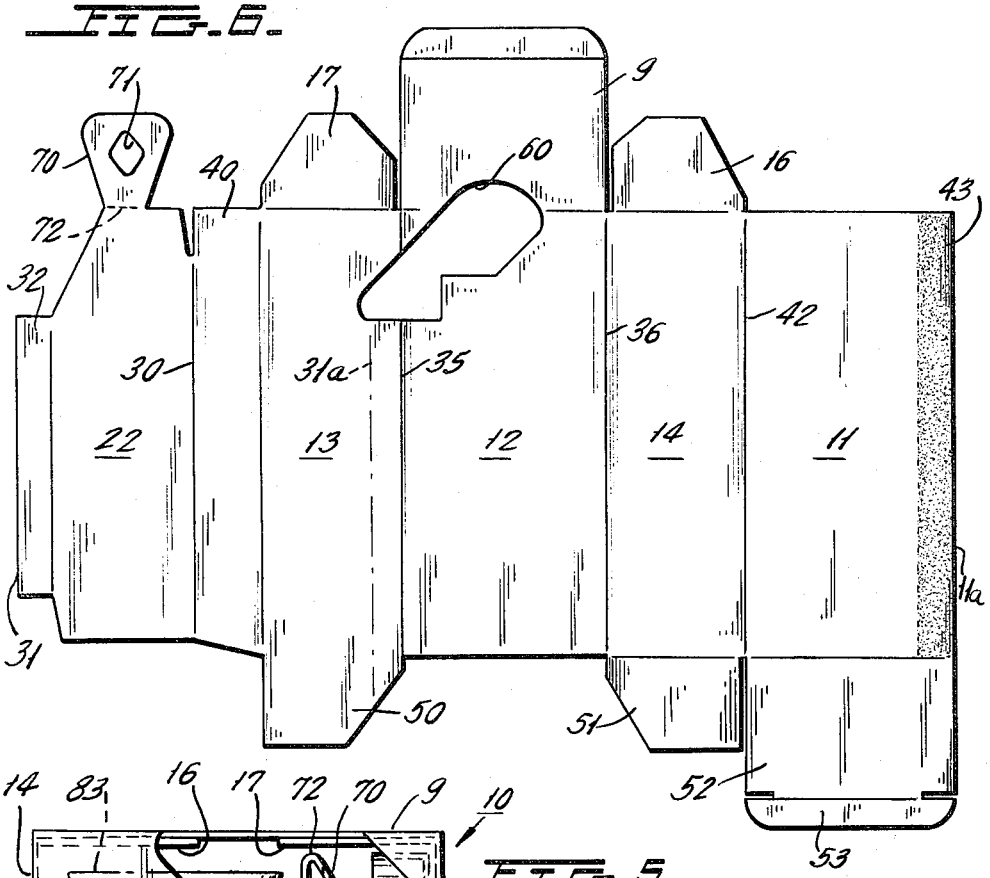
FIG. 6 is a plan view of the blank from which the carton of FIG. 1 is erected.

Comparing FIGS. 6, 2 and 1 and following them in the order named: the side wall 22 is first folded around the fold line 30 to a position where the edge 31 of the adhesive panel extension 32 of the panel 22 reaches the section indicated by the dotted line 31*a* on side panel 13. Adhesive is first applied to the outer surface of the extension 31, that is the surface of extension 32 in FIG. 6 opposite to the surface which is visible therein. The composite folded panels 13, 22, 32 are now folded once more around the fold line 35 to a position where the composite folded panels edge 30 reaches the fold line 36 between the rear wall 12 and the side wall 14. Adhesive is applied in the area 40 on the side of the blank opposite to that shown in FIG. 6. Thereafter the panel 11 which is to form the front wall is folded on the fold line 42 and when so folded, section 43 of the panel 11 overlies the adhesive section 40 of the composite panel 13-30-22-32 and the section of wall 11 adjacent its edge 11*a* coincides with the adhesive along the opposite side (with respect to FIG. 6) of section 40 to adhesively secure the said edge 11*a* of said wall at the area 43 to the adhesive strip 40. At the same time, the pressure utilized for this securement operation squeezes the extension 32 of flap 30 down onto the inner surface of flap 13 to result in securement of panel 22 at the area so that the edge 31 of extension 32 extends to the area 31*a* of the blank.

The bottom of panels 13 and 14 are provided with dust excluding flaps 50, 51 and the bottom of panel 11 is provided with a bottom cover 52 and an adhesive flap 53 so that the bottom may be completed before anything is inserted into the carton.

A die cut opening 60 is made in the blank in the wall 12 and extending into the panel 13 forming the side wall. This provides a means for identifying the object within the carton and also particularly for identifying the cap which is utilized in connection therewith and to permit the customer to make certain that the carton is properly packed at the time he takes it from the shelf.

The two compartments hereinbefore referred to, namely compartments 20 and 21, are thus formed by the auxiliary panel 20 which has been secured in position as above pointed out.

When the carton is erected from the position of FIG. 6 through the position of FIG. 2 to the position of FIG. 1 the compartments 20 and 21 are automatically formed as is obvious from a comparison of this sequence of figures; and the bottom closure is affected as is also obvious from the comparison of the sequence of these figures.

The panel 22 which is to form the auxiliary wall that separates the two compartments 20 and 21 has an upwardly directed extension 70 having preferably a diamond shaped opening 71 therein and, although it may be provided with a bend line 72 between panel 22 and extension 70, it need not necessarily have such a bend line.

Figure 5:
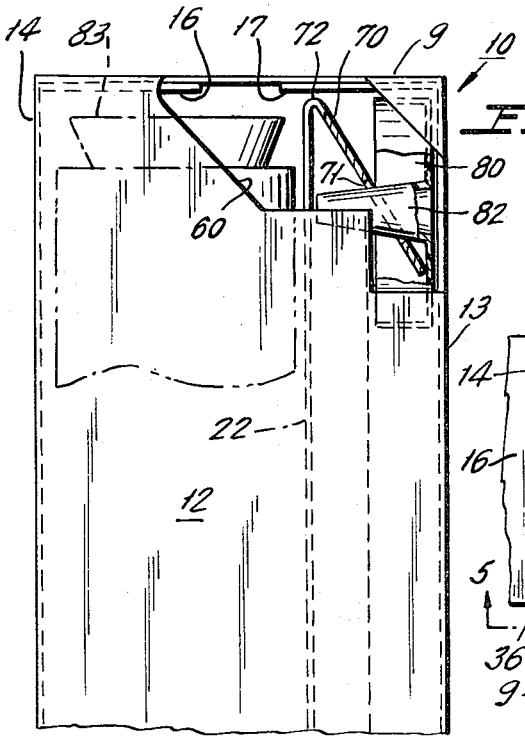
FIG. 5 is a rear view of the container of FIG. 1 taken from line 5—5 of FIG. 4 looking in the directions of the arrows.
Figure 4:
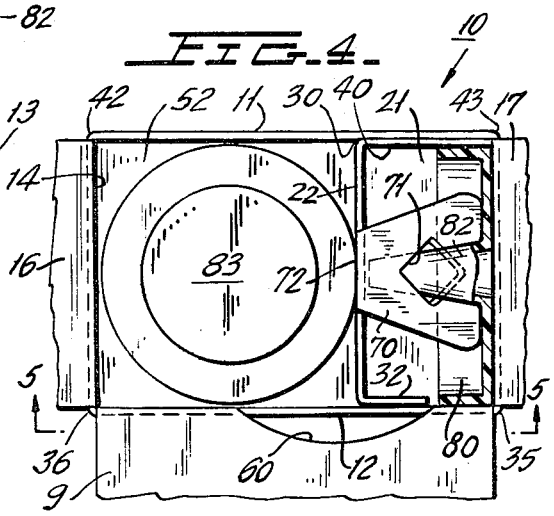
FIG. 4 is a view taken from line 4—4 of FIG. 1 looking in the direction of the arrows.

In operation the principal can or container to be packaged in the carton is loaded through the open top of FIG. 1 into the compartment 20 to occupy the position shown in FIG. 5. The adaptor cap 80 (FIG. 5) is then connected by the opening 71 to the upwardly extending tab 70 and inserted into the compartment 21. The inherent resilience of the tab 70 will thus maintain the cap 80 at or near the top of the compartment 21 for ready access.

In most cases, the cap 80 will be provided with a prong or extension 82 adapted to enter any opening which is formed in the container 83 (see FIG. 5). The diamond shaped opening 71 provides for inherently positioning almost any shape of extension 82 and resiliently maintaining the cap 80 near the top as shown in FIG. 5. At the same time, the side of the cover and the top of the container are visible through the opening 60 in the walls 12 and 13 of the container.

In the foregoing, the present invention has been described solely with respect to illustrative embodiments thereof. Since many variations and modifications of this invention will now be obvious to those skilled in the art, it is preferred that the scope of this invention be determined not by the specific disclosures herein contained but only by the appended claims.

What is claimed is:

1. A carton including a main and an auxiliary compartment, said auxiliary compartment for holding an article therein, said article having a projecting prong connected to a cap member, said carton including a means for supporting said article adjacent the top end thereof, said carton comprising:

an elongated tubular side wall having top and bottom ends and including opposed, parallel front and back walls, and a pair of opposed, parallel side walls;

means for closing said top and bottom ends of said tubular side wall;

an auxiliary wall extending between said front and back walls and connected thereto, said auxiliary wall being disposed parallel to said side walls, said auxiliary wall for defining said main and auxiliary compartments within said carton; and support means including a single unitary tab member hingedly connected to the top edge of said auxiliary wall, with the length of said tab member, measured from said hinged connection to the opposed free end thereof, being greater than the width of said auxiliary compartment, measured from said auxiliary wall to the associated side wall, said tab member including a central aperture therein, said single tab member being wholly disposed within said auxiliary compartment at an acute angle relative to said auxiliary wall, whereby with said prong being received in the aperture of the tab member, the article is supported adjacent the top end of said carton by said tab member.

2. A carton as recited in claim 1 wherein said single tab member is tapered, with the width of said free end being less than the length of said auxiliary compartment, measured from said front wall to said back wall, and with the width of said tab member adjacent said auxiliary wall being less than the width of the free end thereof.

3. A carton as recited in claim 1 formed from a single sheet of cardboard material.

4. A carton as recited in claim 1 wherein an opening is provided in said tubular side wall in register with said auxiliary compartment and adjacent the upper end of said carton, said opening for exposing at least a portion of said article within said auxiliary compartment.

5. A carton as recited in claim 1 wherein said central aperture in said single tab member is generally diamond-shaped in configuration.

* * * * *